US007964069B2

(12) United States Patent
Bergmann et al.

(10) Patent No.: US 7,964,069 B2
(45) Date of Patent: Jun. 21, 2011

(54) DEVICE FOR GALVANIC COATING OF A PISTON

(75) Inventors: Rudolf Bergmann, Alzenau (DE); Kurt Nikolei, Geiselbach (DE)

(73) Assignee: MAHLE International GmbH, Stuttgart (DE)

( * ) Notice: Subject to any disclaimer, the term of this patent is extended or adjusted under 35 U.S.C. 154(b) by 964 days.

(21) Appl. No.: 11/897,473

(22) Filed: Aug. 30, 2007

(65) Prior Publication Data

US 2008/0053824 A1 Mar. 6, 2008

(30) Foreign Application Priority Data

Sep. 5, 2006 (DE) ..... 10 2006 042 049

(51) Int. Cl.
*B05C 19/00* (2006.01)
*B05C 13/00* (2006.01)
*B05D 7/00* (2006.01)

(52) U.S. Cl. ..... 204/285; 204/297.01; 204/298.15; 269/287; 269/54.2; 427/435; 427/436; 427/437; 427/438; 427/439; 427/440; 427/441; 427/442; 427/443.1; 427/443.2; 118/428; 118/500; 118/501; 118/502; 118/503; 118/504; 118/505

(58) Field of Classification Search ..... 204/285, 204/297.01, 298.15; 118/428, 500, 501, 118/502, 503, 504, 505; 269/287, 54.2; 427/435–443.2
See application file for complete search history.

(56) References Cited

FOREIGN PATENT DOCUMENTS

| | | | |
|---|---|---|---|
| EP | 1 520 915 A2 | | 4/2005 |
| JP | 6324267 | * | 2/1988 |
| JP | 4-224695 A | | 8/1992 |
| JP | 10-195695 A | | 7/1998 |
| JP | 11-200095 A | | 7/1999 |
| JP | 2005-060758 A | | 3/2005 |

* cited by examiner

*Primary Examiner* — Harry D Wilkins, III
*Assistant Examiner* — Zulmariam Mendez
(74) *Attorney, Agent, or Firm* — Collard & Roe, P.C.

(57) ABSTRACT

A device for galvanic coating of a piston has a pot-shaped interior for accommodating the piston and an electrolyte fluid, a holder device for fixing the piston in place, a cover that is structured like a shutter and leaves only the surfaces of the piston that are to be coated uncovered, a first electrical contact that is connected with an anode and with the plus pole of a direct voltage source, and a second electrical contact that connects the piston with the minus pole of a direct voltage source. The piston can be simply and quickly attached to the holder device, since the holder device is in plate shape, and has an oblong centering device, the length of which corresponds to the radial inside diameter of the piston to be coated so that the piston can be pushed onto the centering device by way of its underside.

6 Claims, 2 Drawing Sheets

DEVICE FOR GALVANIC COATING OF A PISTON

BACKGROUND OF THE INVENTION

1. Field of the Invention

The invention relates to a device for galvanic coating of a piston.

2. The Prior Art

A device for galvanic coating of a piston, which has a pot-shaped container for an electrolyte fluid, into which a piston to be coated and rod-shaped anodes connected to the plus pole of a direct voltage source are immersed, is described in European patent application EP 1 520 915 A2. In this connection, the piston is first attached to a holder device so that it stands in good electrical contact with it, after which a shielding can be pushed over the piston and screwed onto the holder device. Subsequent to this, the holder device is suspended on a rod by a hook. The rod is connected with the minus pole of a direct voltage source before the holder device with the piston and the shielding is immersed into the pot with the electrolyte fluid. In this connection, the effort that is required to attach the piston and the shielding to the holder device and to bring the holder device and thereby also the piston into electrical contact with the direct voltage source is a disadvantage.

SUMMARY OF THE INVENTION

It is therefore an object of the invention to avoid this disadvantage of the state of the art. This object is accomplished by a device for galvanic coating of a piston, which has a piston crown, skirt elements formed onto the latter, and two pin bores. The device has a pot-shaped interior for accommodating the piston and an electrolyte fluid. There is a holder device for fixing the piston in place, and which has a cover that is structured like a shutter, is disposed close to the piston, and leaves only the surfaces of the piston that are to be coated uncovered. The device has a first electrical contact that is connected with an anode to be immersed into the electrolyte fluid, and with the plus pole of a direct voltage source. There is a second electrical contact that is connected with the piston and with the minus pole of a direct voltage source. The holder device is essentially shaped in plate shape and disposed on the bottom of the interior. There is a centering device shaped in oblong form disposed in the center of the holder device, the longitudinal axis of which device lies parallel to the plane of the holder device, and the length of which corresponds to the radial inside diameter of the piston to be coated, in the region of the skirt elements. The piston to be coated can be pushed onto the centering device by way of its side that faces away from the piston crown. As this is done, the longitudinal axis of which device comes to lie perpendicular to the axis of the pin bores and perpendicular to the piston axis of the piston to be coated. The cover is attached to the radially outer edge of the holder device.

Because of the fact that the holder device is essentially shaped in plate form, on which a centering device structured in oblong manner is situated, the length of which corresponds to the radial inside diameter of the piston in the region of the skirt elements, the piston can be pushed onto the holder device simply and quickly, and can also be quickly removed from it after coating. Furthermore, the cover is attached to the radially outer edge of the holder device, so that coverage of the piston surfaces that are not supposed to be coated already comes about when the piston is pushed onto the holder device.

BRIEF DESCRIPTION OF THE DRAWINGS

Other objects and features of the present invention will become apparent from the following detailed description considered in connection with the accompanying drawings. It is to be understood, however, that the drawings are designed as an illustration only and not as a definition of the limits of the invention.

In the drawings, wherein similar reference characters denote similar elements throughout the several views.

DETAILED DESCRIPTION OF THE PREFERRED EMBODIMENT

Figure 1:
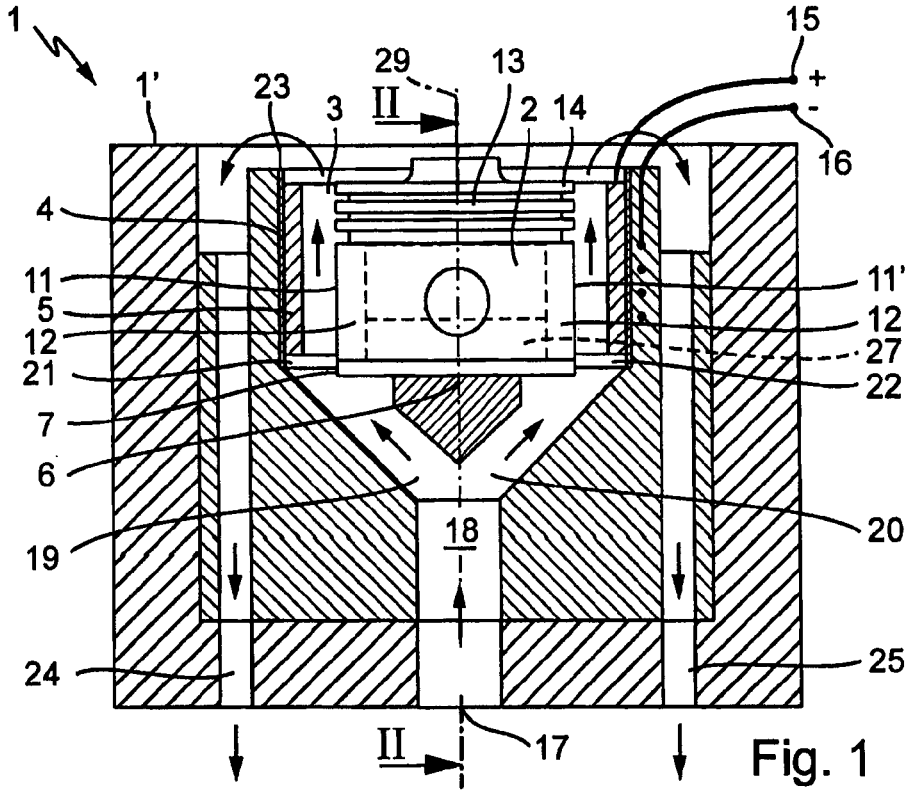
FIG. 1 shows a section through a device for coating a piston, along the line I-I in FIG. 2.
Figure 2:
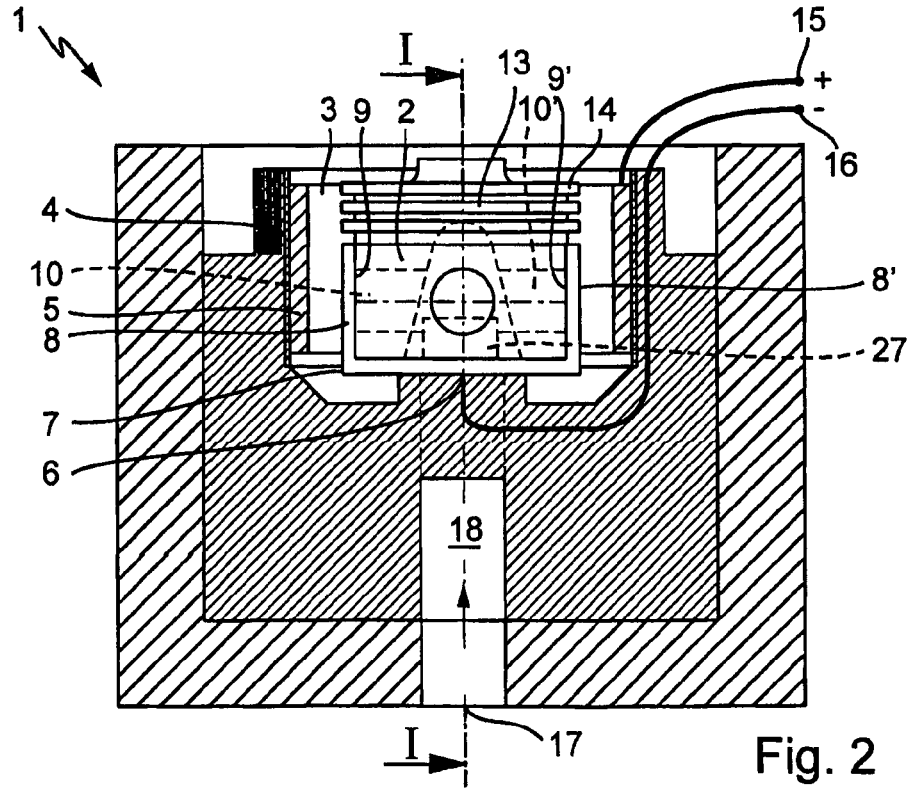
FIG. 2 shows a section through the device along the line II-II in FIG. 1.

FIGS. 1 and 2 each show a section through a device 1 for galvanic coating of a piston 2, whereby the two section planes stand perpendicular to one another, so that FIG. 2 represents a section along the line II-II in FIG. 1, and FIG. 1 represents a section along the line I-I in FIG. 2.

The device consists of polypropylene (PP) and essentially has the shape of a pot, in interior 3 of which piston 2 to be coated (not shown in section) is disposed. An anode 5 having the shape of a cylinder is disposed on the radially outer wall 4 of the interior 3, which anode consists of platinum-plated titanium. In this connection, anode 5 merely has to be inserted into the interior 3. A holder device 7 is disposed on bottom 6 of interior 3, to accommodate piston 2, which device will be explained in greater detail below, and piston 2 to be coated merely has to be set onto this device, without any further attachment measures being required. Holder device 7 (8, 8', 27) consists of a metal that conducts electricity well, such as aluminum or copper, for example.

Holder device 7 has two covers 8, 8' that lie opposite one another, shown in FIG. 2, the purpose of which consists in closing off radially outer openings 9, 9' of pin bores 10, 10' shown in FIG. 2 with broken lines, so that they remain free of coating material during the coating process. The radially outer surfaces 11, 11' of the two skirt elements 12, 12' of piston 2, ring belt 13 and top land 14 of piston 2 are not covered and are therefore coated (see FIGS. 3 and 4 in this regard). In this connection, covers 8, 8' have the further function of fixing piston 2 in place in the direction of the axes of pin bores 10, 10'.

Fixation of piston 2 in the direction that lies perpendicular to this takes place by means of a centering device 27 disposed on the lower part of holder device 7, which has the shape of a bar, and the length of which, as shown with broken lines in FIG. 1, corresponds to the radial inside diameter of piston 2 in the region of skirt elements 12, 12', so that piston 2 can easily be pushed over it.

In order to get the galvanic coating process going, anode 5 is connected with the plus pole of a direct voltage source, by way of a first electrical contact 15, and holder device 7, 8, 8', 27 and thereby piston 2 held by it is connected with the minus pole of the direct voltage source, by way of a second electrical contact 16. Furthermore, an electrolyte fluid is passed into interior 3 by way of an inflow opening 17, by way of an inflow channel 18, by way of side channels 19, 20 that branch off from inflow channel 18, and by way of inlet openings 21 and 22 that lie radially on the outside, by way of which interior 3 is connected with side channels 19, 20. Since the piston consists of aluminum in the present exemplary embodiment and is supposed to be coated with iron, the electrolyte fluid is an iron electrolyte.

The electrolyte fluid is pumped into interior 3 at such a pressure that it flows past outside surfaces 11, 11' of skirt elements 12, 12', ring belt 13, and top land 14 at a speed that is suitable for optimal galvanic coating. Subsequently, the electrolyte fluid is flushed over top edge 23 of interior 3 and passed out by way of outflow channels 24 and 25. Edge 23 of interior 3 is set back downward with regard to the radially outer region of upper face 1' of coating device 1 so that the electrolyte fluid easily goes into outflow channels 24, 25, without spilling over the outer region of face 1' of coating device 1.

Figure 3:
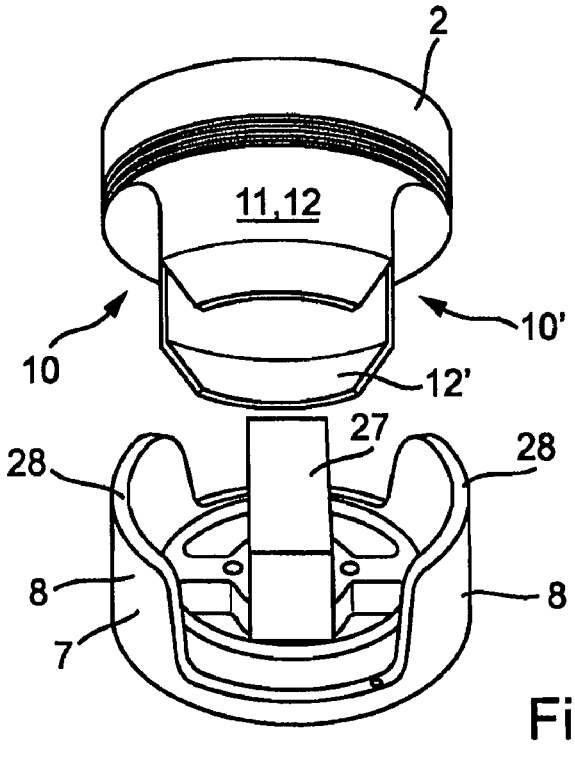
FIG. 3 shows a side view of the piston accommodation within the framework of its being fitted with a piston.
Figure 4:
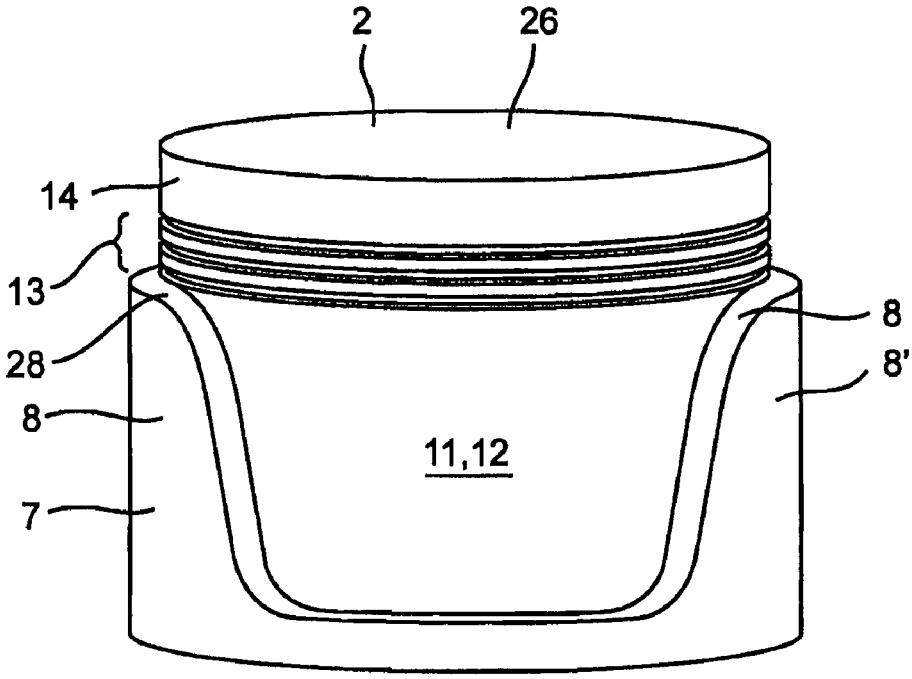
FIG. 4 shows the piston accommodation with a piston disposed in it and with the covers that cover those parts of the piston that are not supposed to be coated.

FIG. 3 shows holder device 7 shortly before a piston 2 is set onto it, and FIG. 4 shows how piston 2 sits on the holder device 7. It is easy to see covers 8, 8' that cover piston 2 to such an extent that only skirt elements 12, 12', ring belt 13, and top land 14 remain free and can be wetted by the electrolyte fluid, so that these surfaces are coated with iron. To what extent piston crown 26 is also coated depends on how far piston 2 is immersed into the electrolyte.

In FIG. 3, bar-shaped centering device 27 can also be seen well; it is disposed in the center of the holder device and has the task of centering piston 2 on holder device 7 to such an extent that outer edge 28 of cover elements 8, 8' lies flush against piston 2, so that no electrolyte fluid can penetrate into pin bores 10, 10'.

Accordingly, while only a few embodiments of the present invention have been shown and described, it is obvious that many changes and modifications may be made thereunto without departing from the spirit and scope of the invention.

REFERENCE SYMBOL LIST

1 device for coating a piston 2
1' upper face of the device 1
2 piston
3 interior
4 outer wall of the interior
5 anode
6 bottom of the interior 3
7 holder device
8, 8' cover
9, 9' outer openings of the pin bores 10, 10'
10, 10' pin bores
11, 11' outer surface
12, 12' skirt element
13 ring belt of the piston 2
14 top land of the piston 2
15 first electrical contact
16 second electrical contact
17 inflow opening
18 inflow channel
19, 20 side channel
21, 22 inlet opening
23 edge of the interior
24, 25 outflow channel
26 piston crown
27 centering device
28 outer edge of the cover elements 8, 8'
29 piston axis

What is claimed is:

1. A device for galvanic coating of a piston, the piston having a piston crown, skirt elements formed onto the latter, and two pin bores, the device comprising:

a pot-shaped interior for accommodating the piston and an electrolyte fluid;

a plate-shaped holder device for fixing the piston in place, said holder device being disposed in a bottom of the interior;

a cover attached to radially outer edges of the holder device, said cover being structured like a shutter and disposed close to the piston, and leaving only surfaces of the piston that are to be coated uncovered;

a first electrical contact that is connected with an anode to be immersed into an electrolyte fluid, and with a plus pole of a direct voltage source; and a second electrical contact that is connected with the piston and with a minus pole of the direct voltage source; and a centering device shaped in oblong form and disposed in a center of the holder device, said centering device having a longitudinal axis that lies parallel to a plane of the holder device, said centering device having a length corresponding to a radial inside diameter of the piston to be coated in a region of the skirt elements, so that the piston to be coated can be pushed onto the centering device by way of a side that faces away from the piston crown and so that the longitudinal axis of the centering device lies perpendicular to an axis of the pin bores and perpendicular to a piston axis of the piston to be coated.

2. A device according to claim 1, wherein the holder device consists of an electrically conductive material and is electrically connected with the second electrical contact so that the piston, when attached to the holder device and standing in galvanic contact with the holder device, is also electrically connected with the second electrical contact.

3. A device according to claim 1, wherein the anode is cylindrical in shape and is disposed on a radially outer wall of the interior.

4. A device according to claim 1, wherein the anode consists of platinum-plated titanium.

5. A device according to claim 1, wherein the bottom of the interior has inlet openings that are connected with channels for supplying electrolyte fluid.

6. A device according to claim 5, wherein the inlet openings are disposed radially on an outside of the interior and close to the surfaces of the piston that are to be coated.

* * * * *